US005869818A

United States Patent [19]

Kim

[11] Patent Number: 5,869,818

[45] Date of Patent: Feb. 9, 1999

[54] MICROWAVE OVEN WITH ENCLOSED CHOKE PRINTED CIRCUIT BOARD

[75] Inventor: Sang-Han Kim, Suwon, Rep. of Korea

[73] Assignee: Samsung Electronics Co., Ltd., Suwon, Rep. of Korea

[21] Appl. No.: 893,776

[22] Filed: Jul. 11, 1997

[30] Foreign Application Priority Data

Apr. 10, 1997 [KR] Rep. of Korea ..... 97 13178

[51] Int. Cl.[6] ..... H05B 6/80

[52] U.S. Cl. ..... 219/757; 219/702; 361/678; 361/692; 361/720

[58] Field of Search ..... 219/757, 756, 219/702, 736; 361/676, 678, 688, 690, 693, 720, 752, 692; 333/181, 182

[56] References Cited

U.S. PATENT DOCUMENTS 4,858,362 8/1989 Takeuji ..... 219/757

5,069,641 12/1991 Sakamoto et al. ..... 333/182

5,587,884 12/1996 Raman ..... 361/728

5,674,425 10/1997 Hong ..... 219/757

*Primary Examiner*—Philip H. Leung

*Attorney, Agent, or Firm*—Burns, Doane, Swecker & Mathis, L.L.P.

[57] ABSTRACT

A microwave oven includes a protective cover for enclosing a choke PCB, on which a choke device and a fuse are mounted, whereby moisture is not formed on the choke device and fuse, and the choke device and fuse are protected against contact. The accidental protective cover has vent slots and is provided near a rear plate forming one portion of the housing of the microwave oven. Air slots, through which outside air is drawn, are formed on a portion of the rear plate that faces the vent slots of the protective cover.

4 Claims, 3 Drawing Sheets

MICROWAVE OVEN WITH ENCLOSED CHOKE PRINTED CIRCUIT BOARD

BACKGROUND OF THE INVENTION (1) Field of the Invention

The present invention relates to a microwave oven, and more particularly, to a choke printed circuit board including a choke means mounted thereon, which is provided in the electric component compartment.

(2) Description of the Prior Art

Generally, a microwave oven is a cooking appliance which cooks food by frictional heat generated by making the molecules of the food being cooked move at high speeds utilizing high frequency energy. FIG. 3 illustrates the inner structure of a prior art microwave oven.

As shown in the figure, the microwave oven includes a housing 10 which consists of an inner case 12 and an outer case 11, and a cooking chamber 20 and an electric component compartment 40 which are isolated from each other by the inner case 12 for forming the cooking chamber 20 and the outer case 11. On the front side of the inner case 12 is rotatably mounted a door 30 to open and close the cooking chamber 20 and is attached a control panel 31i ncluding a display and several operating buttons. The electric component compartment 40 is provided in the space formed between the inner case 12 and the outer case 11. In the electric component compartment 40 are mounted a magnetron 41 for creating microwaves and emitting them to the cooking chamber 20, a guide duct 44 for guiding air drawn into the electric component compartment 40 to the cooking chamber 20 through the intake holes 45 formed on the side plate of the inner case 12, a high-voltage transformer 42 for applying high voltage to the magnetron 41, and a cooling fan 43 for cooling the electric components.

The cooling fan 43 is mounted in the center of the motor bracket 47 which is attached to the inner side of the rear plate enclosing the electric component compartment 40. On the top of the motor bracket 47 is mounted a choke printed circuit board 46 (hereinafter called choke PCB) which includes a choke means 46 a for eliminating noises included in the input power and a fuse 46 b to protect the electric components in the electric component compartment 40.

The choke means 46*a* and fuse 46*b* being uncovered in the electric component compartment 40 can have damaging, and possibly dangerous, results: When the cooling fan 43 operates, air is heat-exchanged with the magnetron 41, directed to the cooking chamber 20, and then discharged outside. At this time, a portion of the air passing through the microwave oven re-enters the electronic component compartment 40. Accordingly, moisture is generated in the electric component compartment 40 due to the temperature difference between the re-entered air and newly entered air. If it contacts the choke means 46*a* or the fuse 46*b*, which are exposed in the electric component compartment 40, a short circuit may be caused, thereby resulting in damage to the machine and a possible fire hazard. Furthermore, when a repair man inspects or repairs the microwave oven after disassembling the outer case 11, he may receive an electric shock by contacting the choke means 46*a* or the fuse 46*b* charged with electricity. Lastly, because the top surface of the exposed choke PCB 46 becomes covered with dust, the parts on the choke PCB 46 may not function properly.

SUMMARY OF THE INVENTION

It is the object of the present invention to provide a microwave oven that includes a protective cover for enclosing a choke PCB, on which a choke means and a fuse are mounted, whereby moisture is not formed on the choke means and fuse and careless contact of a portion of the body with the choke means and fuse is prevented.

A microwave oven according to this invention includes a housing partitioned into a cooking chamber and an electric component compartment, a choke PCB mounted in the electric component compartment for eliminating noises included in the input source, wherein a protective cover with vent slots thereon is provided to enclose the choke PCB.

Additionally, the portion of the rear plate of the housing that faces the vent slots of the protective cover also has vent slots through which outside air is drawn.

DETAILED DESCRIPTION OF THE PREFERRED EMBODIMENT

The preferred embodiment of the present invention will be now described in detail with reference to the accompanying drawings.

Figure 1:
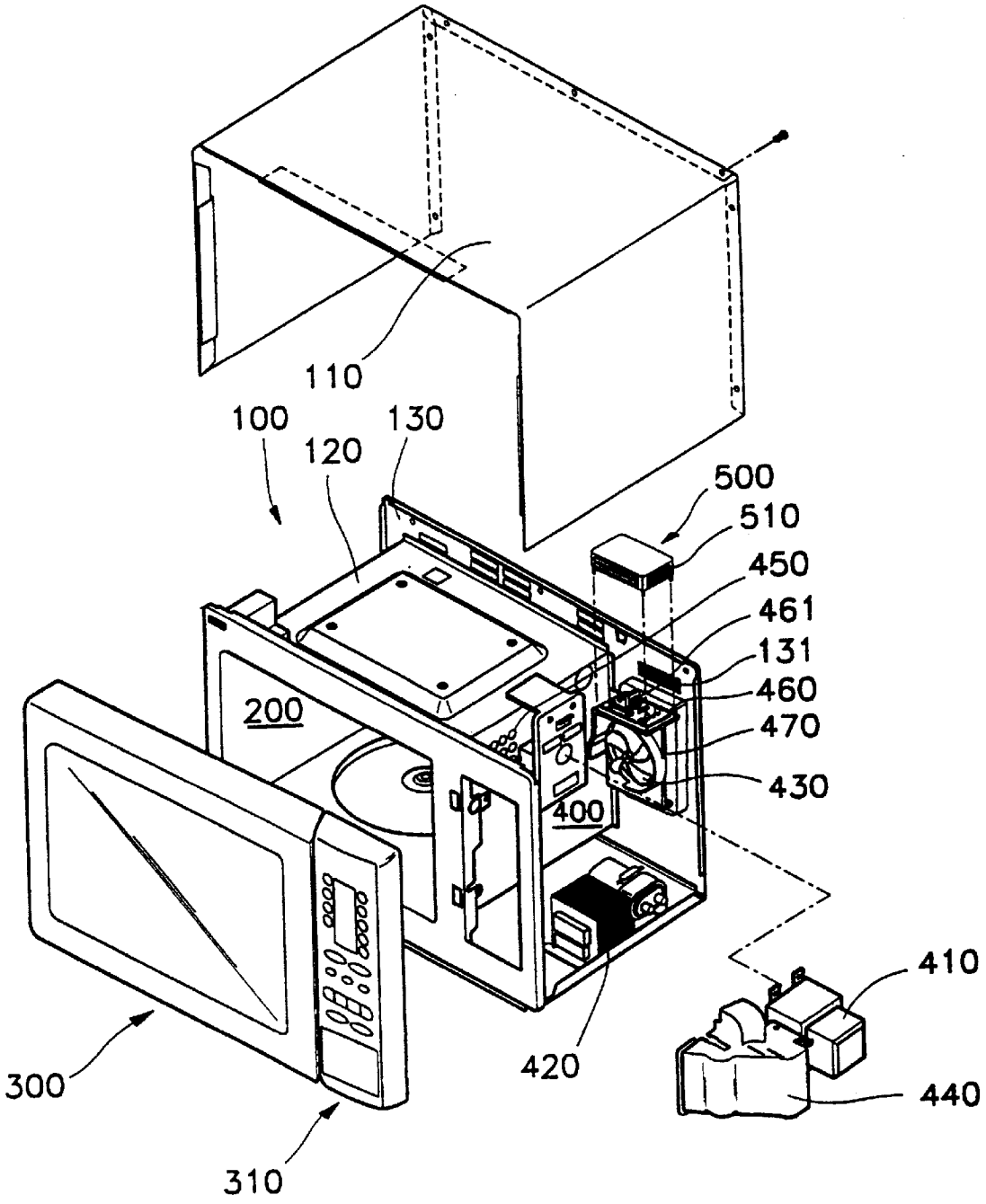
FIG. 1 is an exploded perspective view showing the overall structure of a microwave oven according to the present invention.

As shown in FIG. 1, in the microwave oven according to the present invention, a cooking chamber 200 and an electric component compartment 400 are provided inside a housing 100. The housing is comprised of an inner case 120 forming the cooking chamber the front side of which is opened, an outer case 110 which is attached to the edges of the inner case 120 and forms the electric component compartment 400, and a rear plate 130 forming the rear sides of the cooking chamber 200 and the electric component compartment 400. At the front of the housing 100 are attached a door 300 for opening and closing the cooking chamber 200 and a control panel 310 having operating buttons and displayer for operating the microwave oven.

In the electric component compartment 400 are mounted a magnetron 410 for emitting microwaves to the cooking chamber 200, a high-voltage transformer 420, and a cooling fan 430 for cooling the electric components in the compartment 400. The cooling fan 430 is attached to the center portion of an injection molded motor bracket 470 that is fixed to the inner side of the rear plate 130. At the portion of the rear plate 130 that forms the electric component compartment 400 are formed a plurality of suction holes (not shown) through which outside air is drawn in by the cooling fan 430. A plurality of suction holes 450 are also formed on the side plate of the inner case 120 that divided the cooking chamber 200 and the electric component compartment 400, a guiding duct 440 is attached to the aforementioned side plate, so that the air, which has been drawn into the electric component compartment 400, is guided to the cooking chamber 200.

A choke PCB 460, which functions as an electric control means, is mounted on the flat upper surface of the motor bracket 470. The choke PCB 460, which includes a choke means 461 on which choke coils are wound and a fuse holder 464 on which a fuse 463 is mounted, is used to eliminate noises included in the input power and prevent the supply of over-current, thereby protecting the electric components in the electric component compartment 400. The choke PCB additionally includes a heat-radiating plate 466 and a line-earth condenser 465. Further, a protective cover 500, which is a characteristic element of the present invention, encloses the choke PCB 460 to protect its constituents.

Figure 2:
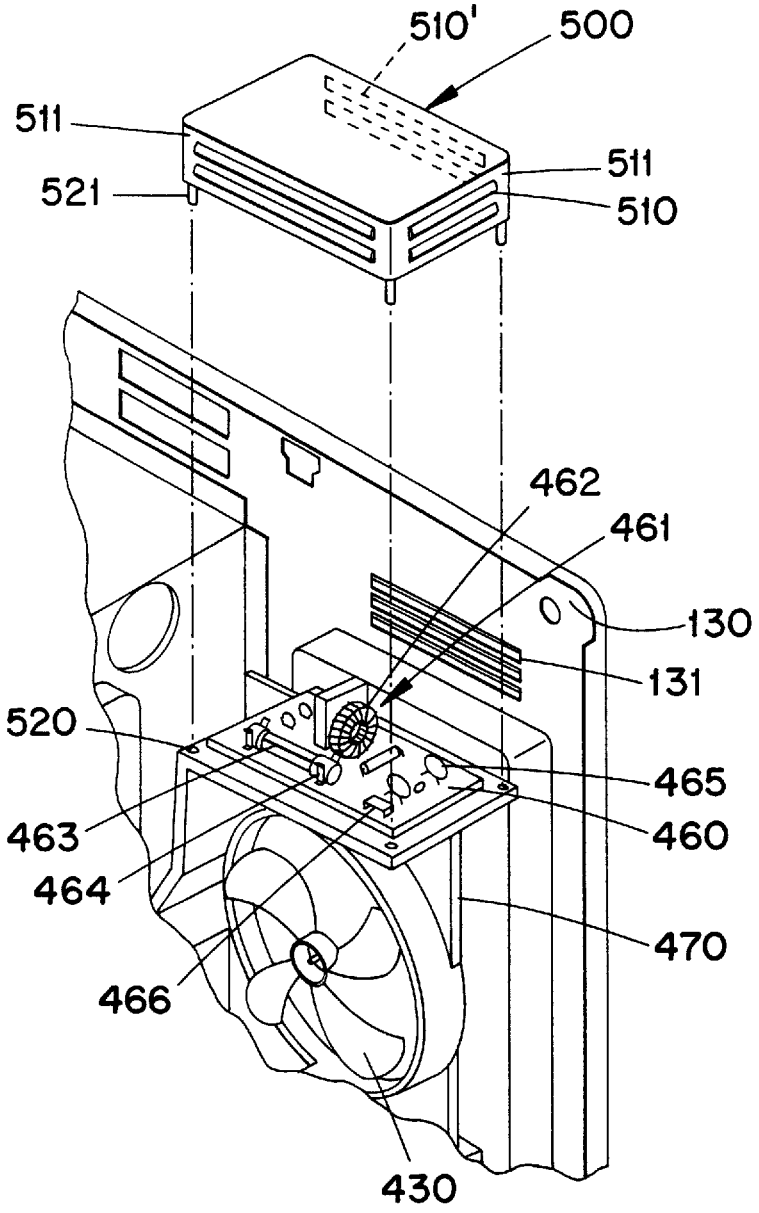
FIG. 2 is an exploded perspective view showing a protective cover according to the present invention.
Figure 3:
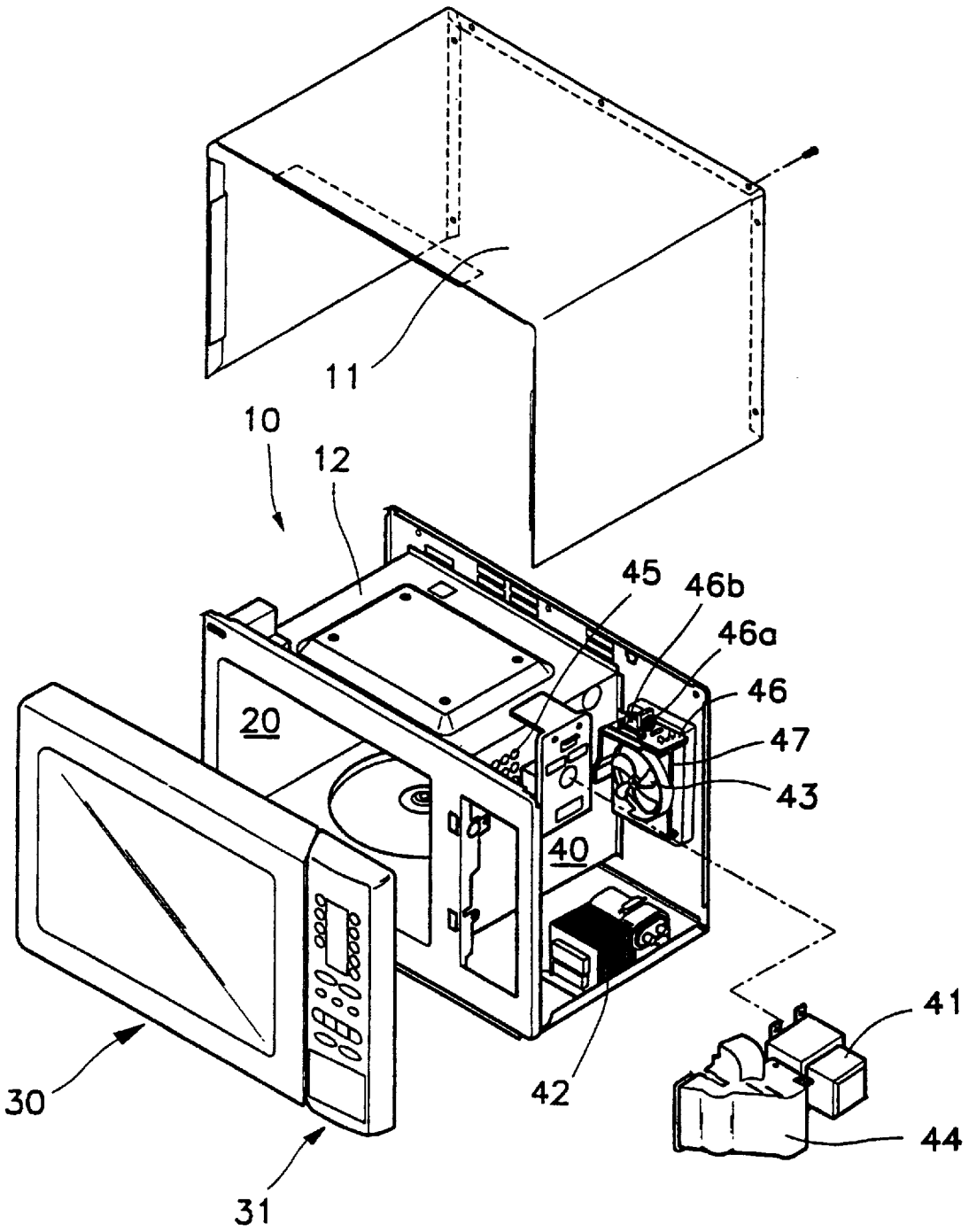
FIG. 3 (PRIOR ART)
FIG. 3 is an exploded perspective view showing the overall structure of a microwave oven according to a prior art.

As shown in FIG. 2, the protective cover 500 is an open-bottomed rectangular box. A plurality of louvered vent slots 510, 510' are formed in the sides 511 of the protective cover 500 so that air flows into the protective cover 500 through the vent slots 510, 510' while condensed moisture is prevented from entering. A plurality of air slots 131 corresponding to the vent slots 510' are formed on the portion of the rear plate 130 that faces the choke PCB 460 and the vent slots 510', so that outside air flows into the protective cover 500 through the air slots 131 and the vent slots 510', thereby cooling the choke means 461 and the fuse 463 mounted on the choke PCB 460.

Fitting holes 520 are formed on the corners of the motor bracket 470 and fitting legs corresponding to the fitting holes 520 are provided on the lower corners of the protective cover 500. That is, the fitting holes 520 are formed nearby the corners of the choke PCB 460 on the top surface of the motor bracket 470, and the fitting legs 521 extend downward from the lower corners of the protective cover 500 so as to insert into the fitting holes 520. Thus, the protective cover 500 is engaged with the top surface of the motor bracket 470 to cover the choke PCB 460 on which the choke means 461 and fuse 463 are mounted. The replacement of parts such as the fuse 463 can be easily carried out because the protective cover 500 is easily disassembled by removing the fitting legs 521 from the fitting holes 520.

The operation of such a microwave oven according to the present invention will be now described in detail.

When the user puts foodstuff in the cooking chamber 200 and operates the control panel 310 with the closed door, microwaves generated by the magnetron 410 are emitted into the cooking chamber 200 to cook the foodstuff. At the same time, outside air that is drawn into the electric component compartment 400 by the cooling fan 430 cools the electric components(e.g. the fuse and choke means) therein, and is then introduced into the cooking chamber 200 through the guiding duct 440 and the suction holes 450. The air circulated in the cooking chamber 200 is discharged outside through discharging holes (not shown) which are formed on one side wall of the cooking chamber 200, thereby eliminating moisture and odors in the cooking chamber 200 which are emitted from the cooking foodstuff.

At this time, a portion of the hot and humid air discharged from the cooking chamber 200 is again drawn into the electric component compartment 400, where it combines with outside air having a relatively lower temperature. Thus, due to condensation, liquid water may be deposited in the electric component compartment 400. However, this does not hinder the performance of the choke means 461 and the fuse 463 because they are protected by the protective cover 500.

Furthermore, even when a repair man inspects or repairs the microwave oven without disconnecting the electrical supply after disassembling the outer case 110, contact of his body with the electric parts is prevented because the choke means 461 and the fuse 463 are covered by the protective cover 500, thereby preventing any danger of electric shock.

What is claimed is:

1. A microwave oven including a housing partitioned into a cooking chamber and an electric component compartment, the housing including upper portions respectively overlying top ends of the cooking chamber and the electric component compartment, the housing further including a rear plate forming a back side of said electric component compartment, and a choke PCB mounted in said electric component compartment for eliminating noises included in the input source, wherein a protective cover separate from and spaced from said housing, is provided nearby said rear plate to enclose said choke PCB, the protective cover including vertical sides in which vent slots are formed, and air slots, through which outside air is drawn, are also formed on a portion of said rear plate that faces vent slots of one of the vertical sides of said protective cover.

2. The microwave oven according to claim 1 further including a fan disposed in the component compartment for drawing air thereinto through the rear plate, the choke PCB and the vent slots being disposed above the fan.

3. The microwave oven according to claim 2 wherein the vent slots have louvers extending thereacross.

4. The apparatus according to claim 2 further including a horizontal bracket mounted above said fan and having a top surface, said PCB mounted upon said bracket, said top surface having holes formed therein, said cover including downwardly projecting legs fitting into said holes.

* * * * *